US012735955B2

(12) United States Patent
Taha et al.

(10) Patent No.: US 12,735,955 B2
(45) Date of Patent: Sep. 15, 2026

(54) BACK PRESSURE VALVE WITH CONTINGENCY RELEASE

(71) Applicant: SAUDI ARABIAN OIL COMPANY, Dhahran (SA)

(72) Inventors: Syed Muhammad Bin Syed Taha, Dhahran (SA); Amr Mohammed Zahran, Al Khobar (SA); Abdullah Mohammedkhair Alkassab, Dhahran (SA); Wafaa Hasan Alnakhli, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 118 days.

(21) Appl. No.: 18/775,709

(22) Filed: Jul. 17, 2024

(65) Prior Publication Data

US 2026/0022620 A1 Jan. 22, 2026

(51) Int. Cl.
*E21B 34/02* (2006.01)

(52) U.S. Cl.
CPC ..... *E21B 34/02* (2013.01)

(58) Field of Classification Search
CPC ..... E21B 34/02; E21B 33/04; E21B 34/04; E21B 33/03; E21B 33/038; E21B 34/025
See application file for complete search history.

(56) References Cited

U.S. PATENT DOCUMENTS 1,073,556 A 9/1913 Adams
1,367,156 A 2/1921 Mcalvay et al.
2,358,677 A 9/1944 Yancey
2,737,248 A 3/1956 Baker
2,958,336 A 11/1960 Yancey
3,068,559 A 12/1962 Gonld
4,058,162 A * 11/1977 Smith ..... E21B 34/02 166/135

(Continued)

FOREIGN PATENT DOCUMENTS

WO WO-2018170500 A1 * 9/2018 ..... F16K 15/063

OTHER PUBLICATIONS

International Search Report & Written Opinion issued in International Application No. PCT/US2025/037824; report mail date Sep. 22, 2025; pp. 1-14.

*Primary Examiner* — Daniel P Stephenson
(74) *Attorney, Agent, or Firm* — Bracewell LLP; Constance G. Rhebergen; Keith R. Derrington

(57) ABSTRACT

A back pressure valve ("BPV") for use in a wellhead assembly has a contingency release means. The BPV is coupled to the wellhead assembly with a threaded connection, that is formed by engaging threads on the BPV with threads in a tubing hanger inside the wellhead assembly. The contingency release means is activated by applying an overpull to the BPV, which retracts the BPV threads radially inward and away from engagement with tubing hanger threads. Disengaging the threads uncouples the BPV from the tubing hanger allowing BPV removal from the wellhead assembly. The BPV threads are on blocks that are disposed around the BPV circumference. The blocks are biased radially inward with springs. Concentric sleeves inside the blocks resist block inward movement. The overpull telescopes the concentric sleeves allowing the springs to urge blocks radially inward, which moves the BPV threads away from the tubing hanger threads.

18 Claims, 8 Drawing Sheets

(56) References Cited

U.S. PATENT DOCUMENTS

| | | | | |
|---|---|---|---|---|
| 4,460,039 | A | 7/1984 | Knight | |
| 5,020,590 | A | 6/1991 | Mcleod | |
| 5,782,297 | A | 7/1998 | Samuels et al. | |
| 8,616,289 | B2 | 12/2013 | Nguyen et al. | |
| 8,636,058 | B2 | 1/2014 | Nguyen et al. | |
| 8,752,634 | B2 | 6/2014 | Tanaka et al. | |
| 9,422,788 | B2 | 8/2016 | Nguyen et al. | |
| 9,810,038 | B2 * | 11/2017 | Cocker, III | E21B 34/025 |
| 9,863,213 | B1 | 1/2018 | Kellam et al. | |
| 12,258,833 | B2 * | 3/2025 | Phillips | E21B 33/0422 |
| 2011/0011575 | A1 * | 1/2011 | Nguyen | E21B 34/025 137/511 |
| 2014/0116720 | A1 | 5/2014 | He et al. | |
| 2015/0041151 | A1 * | 2/2015 | Cocker, III | E21B 33/0415 166/380 |
| 2016/0186527 | A1 | 6/2016 | Cocker et al. | |
| 2016/0273302 | A1 | 9/2016 | Nguyen et al. | |
| 2018/0100368 | A1 * | 4/2018 | Nguyen | E21B 33/04 |
| 2023/0228167 | A1 | 7/2023 | Pang et al. | |
| 2024/0093563 | A1 * | 3/2024 | Cheng | E21B 33/04 |

* cited by examiner

BACK PRESSURE VALVE WITH CONTINGENCY RELEASE

BACKGROUND OF THE INVENTION

1. Field of Invention

The present disclosure relates to a back pressure valve for use in a wellhead assembly, which includes a contingency release means.

2. Description of Prior Art

Hydrocarbon producing wells typically are capped with a wellhead assembly that mounts over an entrance to the well. The wellhead assembly also provides a way for controlled access to the well and a means for routing fluid produced from the well to an offsite location. Hydrocarbon producing wells usually include casing and production tubing, where the casing lines walls of the well to isolate the inner wellbore from the surrounding formation. The tubing is inserted inside the casing for directing fluid extracted from the formation to surface. The casing is typically supported within the wellbore by a casing hanger mounted inside a wellhead housing, and a tubing hanger attaches to an inside of the casing hanger for supporting the tubing.

Sometimes a back-pressure valve ("BPV") is installed inside an upper end of the tubing hanger for controlling flow through the tubing. BPV valves usually operate similar to a check valve by blocking fluid inside the tubing from exiting through the upper end of the tubing hanger and permitting fluid flow into the tubing through the upper end of the tubing hanger. BPVs are mostly utilized for well control purposes and for production tree change outs. BPVs are generally conFIG.d to be complementary to a profile in the upper end of the tubing hanger, and often the BPV and profile have corresponding threads that form a threaded connection when the BPV is installed in the profile. Fluid produced from or injected into the wellbore sometimes contains substances, which over time form deposits on the tubing hanger threads. Corrosion from contact with some produced fluids is another potential source of deposits on the threads. The deposits on the threads create a risk that the BPV cannot be removed from the tubing hanger.

SUMMARY OF THE INVENTION

Disclosed herein is an example of a back pressure valve for use in a wellhead assembly that includes a body having an axis, a recess in the body, a thread segment block radially moveable within the recess, a sleeve assembly selectively changeable from an armed configuration in which the sleeve assembly forms a barrier to radial inward movement of the thread segment block, to an activated configuration in which the sleeve assembly allows radial inward movement of the block, and threads on an outer surface of the thread segment block that are in selective threaded engagement with threads on an inner surface of a bore within the wellhead assembly when the sleeve assembly is in the armed configuration, the threads being spaced radially inward and disengaged from the threads on the inner surface of the bore when the sleeve is in the activated configuration. The back pressure valve optionally further includes a spring in biasing contact with the outer surface of the block, in alternatives, a portion of the body forms a skirt that circumscribes a portion of the recess, and where the spring is compressed between the thread segment block and the skirt when the sleeve assembly is in the armed configuration and exerts a biasing force that moves the thread segment block radially inward when the sleeve assembly is in the activated configuration. In one example, the sleeve assembly includes a retention sleeve adjacent a radial inward side of the thread segment block and an activation sleeve axially moveable within the retention sleeve, optionally, a diameter of a lower end of the actuation sleeve is reduced to define a larger diameter portion and a lower diameter portion, and wherein the retention sleeve is radially compressible, where when the actuation sleeve is moved a distance axially upward so that the larger diameter portion is above an upper end of the retention sleeve, the retention sleeve compresses radially inward into contact with the lower diameter portion to allow inward radial movement of the thread segment block to disengage threads on the thread segment block from threads on the inner surface of the bore. In an alternative, the retention sleeve is made up of arc like segments with gaps between adjacent segments when the sleeve assembly is in the armed configuration, or includes a material that buckles when the sleeve assembly changes from the armed configuration into the activated configuration. In one embodiment, threads are on an inner surface of the activation sleeve that are selectively engaged by a connector for installing the back pressure valve in the wellhead assembly, for removing the back pressure valve from the wellhead assembly, and for changing the sleeve assembly from the armed configuration into the activated configuration. The back pressure valve optionally includes a plurality of recesses and a plurality of thread segment blocks, where the plurality of thread segment blocks are radially moveable in the plurality of recesses and where each of the plurality of thread segment blocks have threads that form a threaded surface extending radially outward from the body when the sleeve assembly is in the armed configuration and that is retracted when the sleeve assembly is in the activated configuration.

Another example of a back pressure valve for use in a wellhead assembly is disclosed that includes a body having an axial bore, a sleeve assembly in the bore having an outer diameter that is selectively reduced by reconfiguring the sleeve assembly from an armed configuration to an actuated configuration, thread block segments that are radially moveable within recesses in the body, the thread block segments having outer radial surfaces with outer surface threads that selectively engage inner surface threads in the wellhead assembly when the sleeve assembly is in the armed configuration and that are disengaged from the inner surface threads when the sleeve assembly is in the activated configuration. The inner surface threads are optionally formed along an inner surface of a tubing hanger inside the wellhead assembly. In an example, lower portions of the recesses extend radially from the axial bore in the body to an outer surface of the body and where upper portions of the recesses have radial terminal ends that are spaced radially inward from an outer surface of the body to define skirts that are axially adjacent the outer surface threads. The back pressure valve includes embodiments with springs between the skirts and the thread segment blocks that bias the thread segment blocks radially inward. Examples of the back pressure valve include the sleeve assembly having a retention sleeve with an outer surface in abutting contact with inner radial surfaces of the thread segment blocks and an actuation sleeve circumscribed by the retention sleeve, and where telescoping the actuation sleeve from within the retention sleeve changes the sleeve assembly from the armed configuration into the actuated configuration.

A method of handling a back pressure valve in a wellhead assembly is disclosed that includes obtaining a back pressure valve having a body with a bore, a sleeve assembly in the bore that is changeable from an armed configuration into an activated configuration, recesses in the body that extend radially outward from the bore, thread block segments in the recesses having outer threads that project radially past an outer surface of the body when the sleeve assembly is in the armed configuration and that retract radially inward from the outer surface of the body when the sleeve assembly is in the activated configuration. This example further includes installing the back pressure valve in the wellhead assembly by engaging the outer threads with inner threads formed within the wellhead assembly, disengaging the outer threads form the inner threads by changing the sleeve assembly from the armed configuration into the activated configuration, and removing the back pressure valve from the wellhead assembly. In an example, the sleeve assembly is made up of concentric sleeves, and where disengaging the outer and inner threads involves axially moving an inner sleeve from within an outer sleeve so that a radius of the outer sleeve reduces to allow the thread block segments to move radially inward. The method further optionally includes applying a radial inward force against the thread block segments. In an example, the radial inward force is from springs disposed between an outer skirt on the body of the back pressure valve and outer surfaces of the thread block segments. In alternatives, a diameter of the inner sleeve changes to define a larger diameter portion and a smaller diameter portion, and where changing the sleeve assembly into the activated configuration includes positioning the inner sleeve so that the larger diameter portion outside of the outer sleeve and the smaller diameter portion remains within the outer sleeve. In examples, the inner and outer sleeves are coupled together when in the activated configuration, and removing the back pressure valve from the wellhead assembly involves engaging threads on an inner surface of the inner sleeve with a connector, and applying an upward force onto the connector.

BRIEF DESCRIPTION OF DRAWINGS

Some of the features and benefits of the present invention having been stated, others will become apparent as the description proceeds when taken in conjunction with the accompanying drawings, in which.

Figure 1:
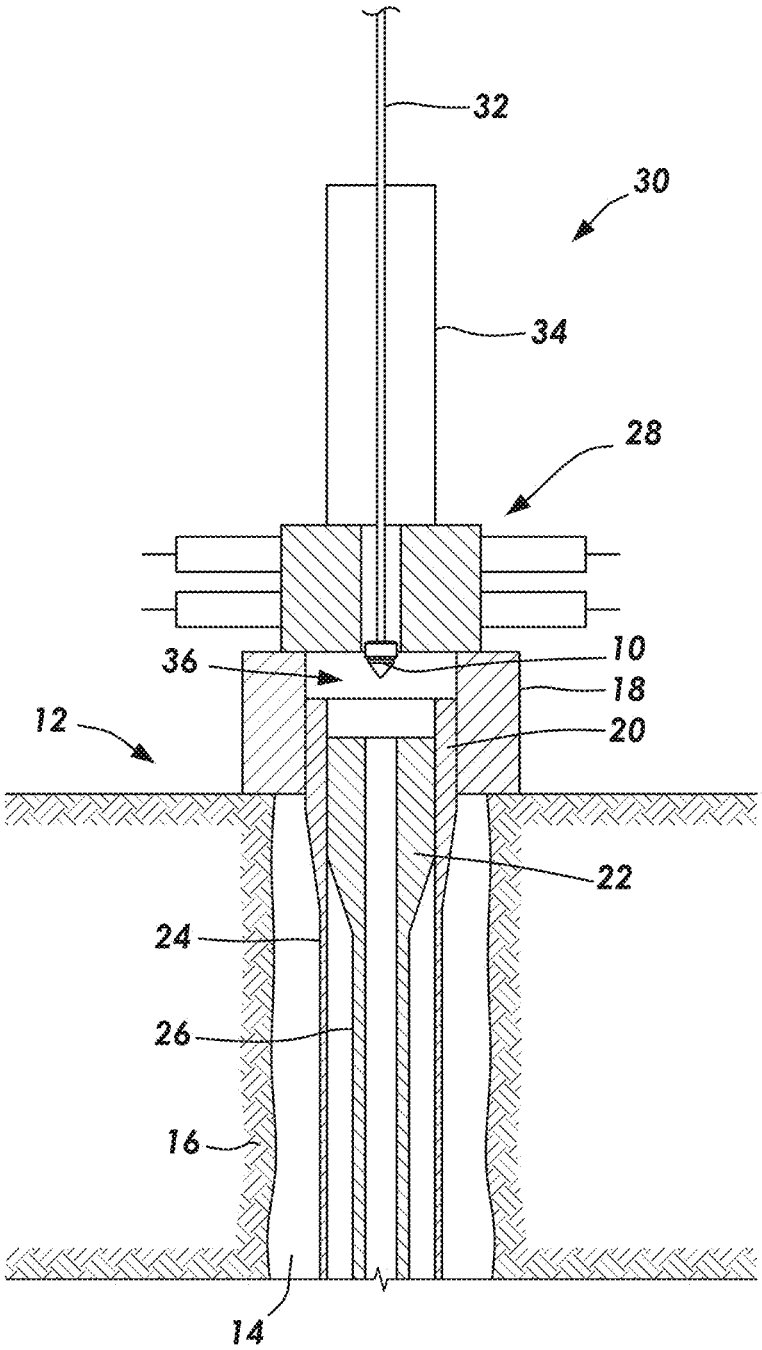
FIG. 1 is side partial sectional view of an example of installing a back pressure valve ("BPV") in a tubing hanger of a wellhead assembly.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a partial side sectional view in FIG. 1 is an example of installing a back pressure valve ("BPV 10") into a wellhead assembly 12 shown mounted over a wellbore 14 that extends into a formation 16. The wellhead assembly 12 includes a wellhead housing 18 on its outer surface, a casing hanger 20 mounted within the housing 18 and a tubing hanger 22 mounted within the casing hanger 20. Casing 24 and tubing 26 extend respectively from the hangers 20, 22 and into the wellbore 14. A blowout preventer ("BOP") 28 is shown attached to an upper end of wellhead housing 18. On an upper end of the BOP 28 is a lubricator assembly 30 with a rod 32 for installing the BPV 10. The lubricator assembly 30 includes a housing 34 shown mounted over the main bore 36 of the wellhead assembly 12, which provides isolation from pressure from within the wellbore 14.

Figure 2:
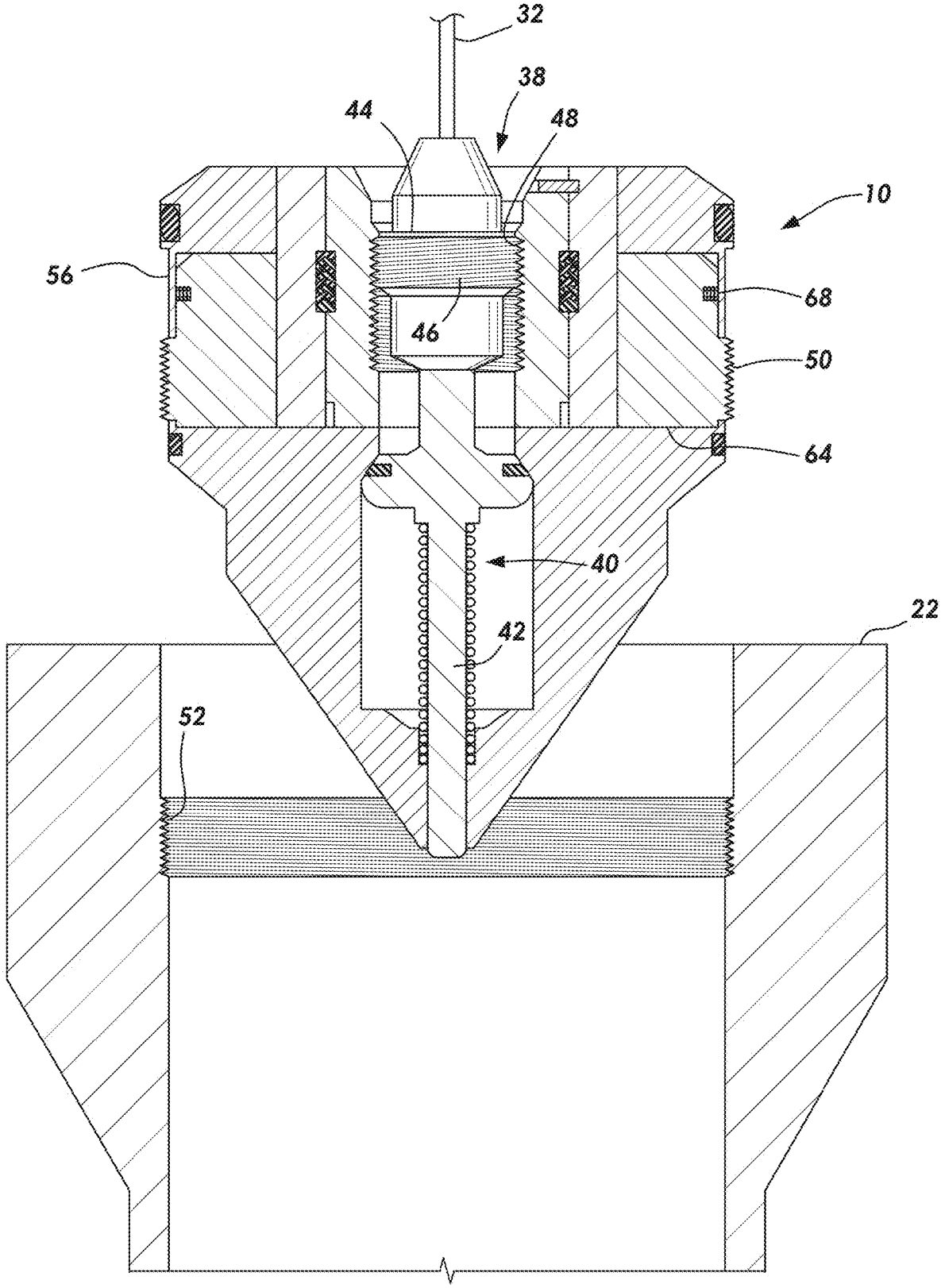
FIG. 2 is a side partial sectional view illustrating the BPV and tubing hanger of FIG. 1 in greater detail.
Figure 3:
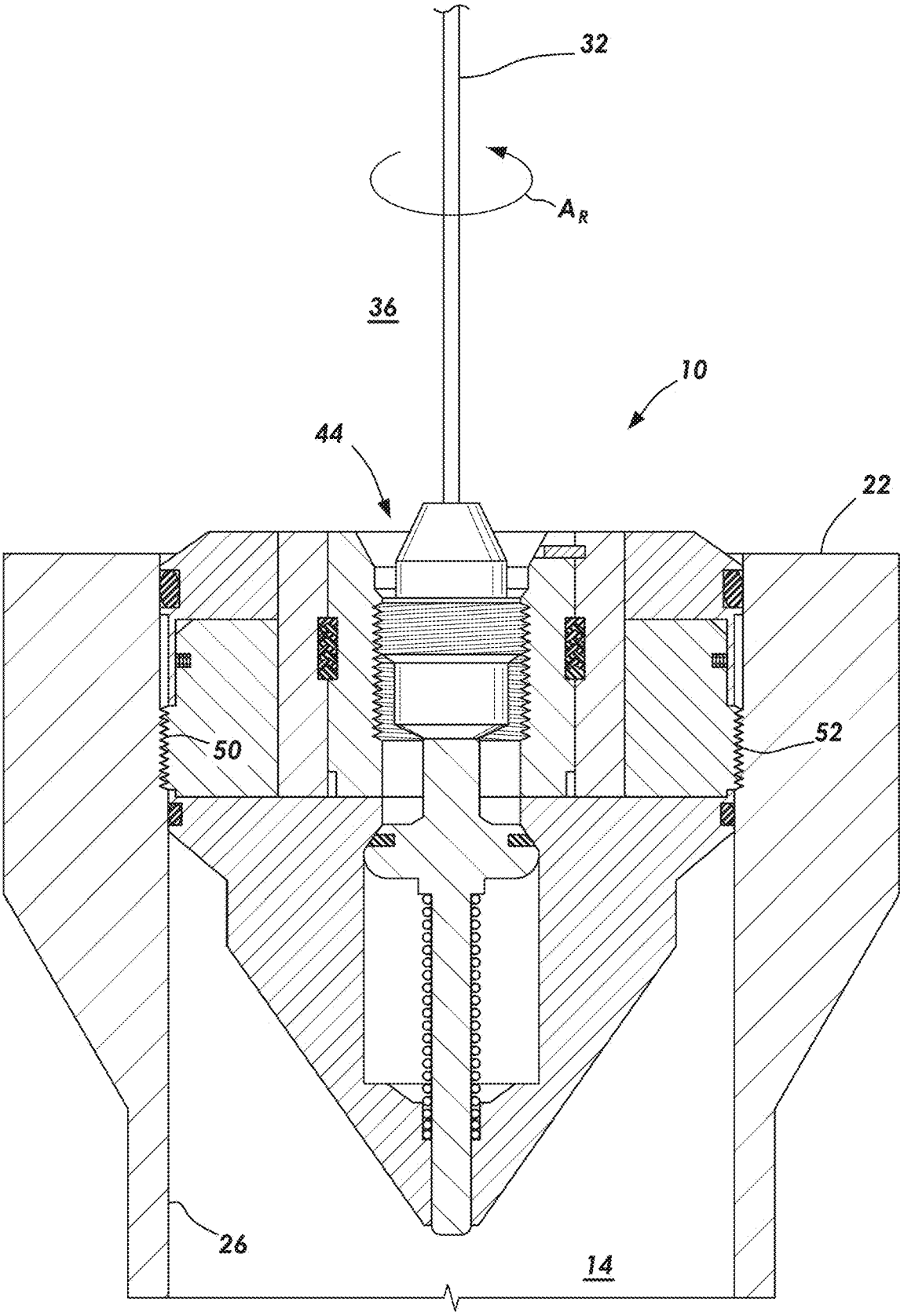
FIG. 3 is a side partial sectional view of the BPV of FIG. 2 being installed in the tubing hanger.

Shown in FIG. 2 is a portion of FIG. 1 illustrated in greater detail. In this example, a valve bore 38 extends axially through the BPV 10. Inside bore 38 is a check valve 40 with attached spring 42 for controlling flow of fluids through the valve bore 38. A connector 44 with threads 46 is shown attached to a lower end of rod 32, threads 46 engage threads 48 formed within the outer surface of valve bore 38. By engaging threads 46, 48 with one another, the BPV 10 couples to rod for insertion into the tubing hanger 22. Outer threads 50 are shown formed on an outer surface of BPV 10 and inner threads 52 are formed on an inner surface of tubing hanger 22. As shown in FIG. 3, BPV 10 is installed in tubing hanger 22 by engaging threads 50 with threads 52. Further shown in FIG. 3 is that rotation of rod 32 in the direction of arrow AR engages threads 46, 48 for attaching the rod to BPV 10. Similarly, rotation in an opposite direction disengages the rod 32 and connector 44 from BPV and allows for removal of the rod 32 and connector 44 from within the wellhead assembly 12.

Figure 4:
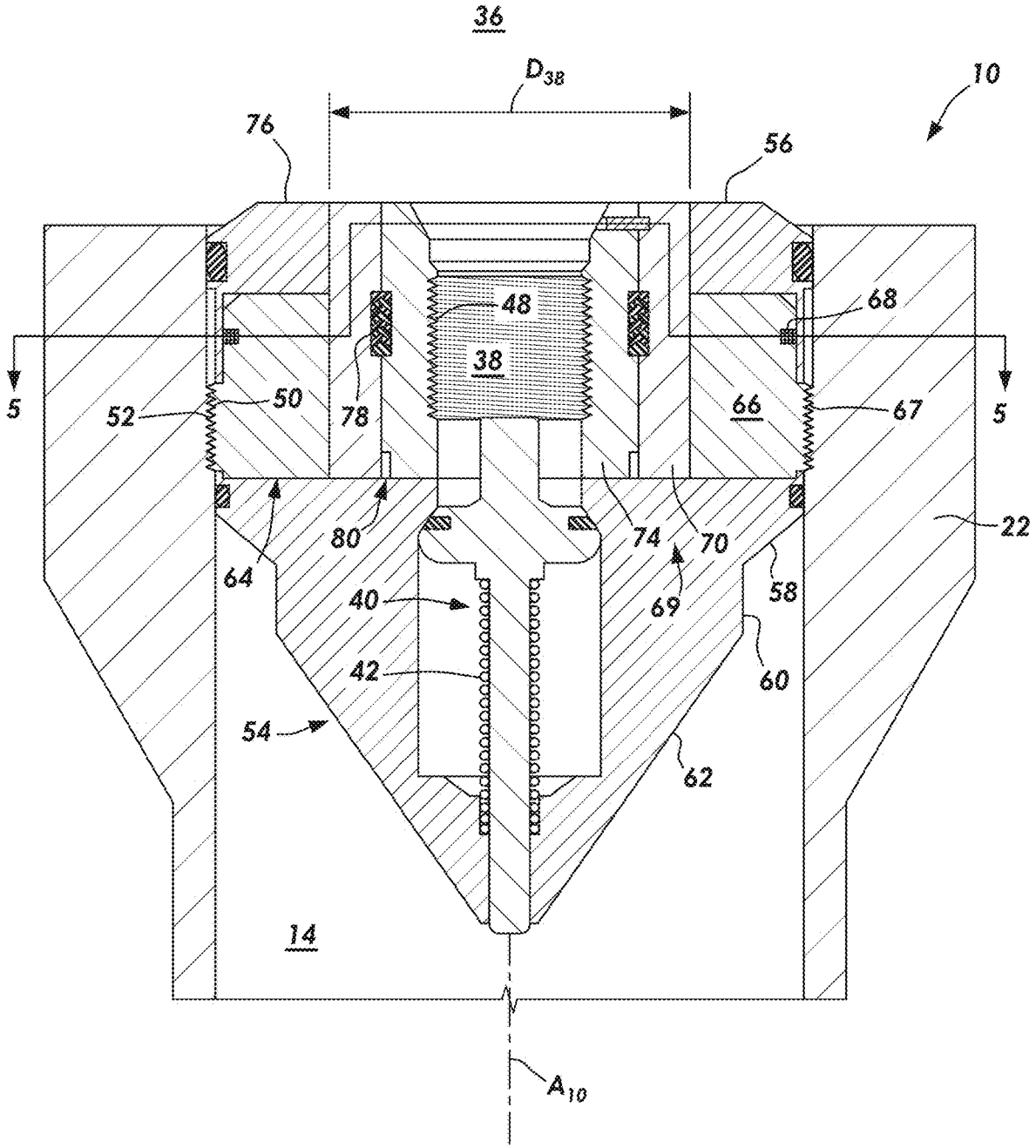
FIG. 4 is a side partial sectional view of the BPV and tubing hanger of FIG. 2, with the BPV installed in the tubing hanger.

Shown in a side partial sectional view in FIG. 4 is the BPV 10 installed within tubing hanger 22 and after the rod 32 and connector 44 have been removed from the main bore 36 (FIG. 3). BPV 10 is shown made up of a body 54 having a generally cylindrical upper section 56, a frusto-conical upper intermediate section 58, a generally cylindrical lower intermediate section 60, and a frusto-conical lower section 62. Recesses 64 are formed in the upper section 56 shown extending radially outward from bore 38. In the recesses 64 are thread segment blocks 66, which are radially movable within the recesses 64. An upper portion of recesses 64 terminates inside body 54 and short of the outer surface of the body 54 to define a skirt 67 that circumscribes upper portions of recesses 64. A lower portion of each of the recesses 64 extends through the outer radial surface of the body 54 to form an opening in the outer surface of the body 54 allowing the threads 52 formed on outer surfaces of the thread segment block 66 to project radially outward past the outer surface of body 54. Springs 68 are shown compressed between the outer surfaces of each of the thread segment blocks 66 and the inner surface of skirt 67. In the example shown, springs 68 exert a radially inward biasing force against the thread segment blocks 66.

Figure 5:
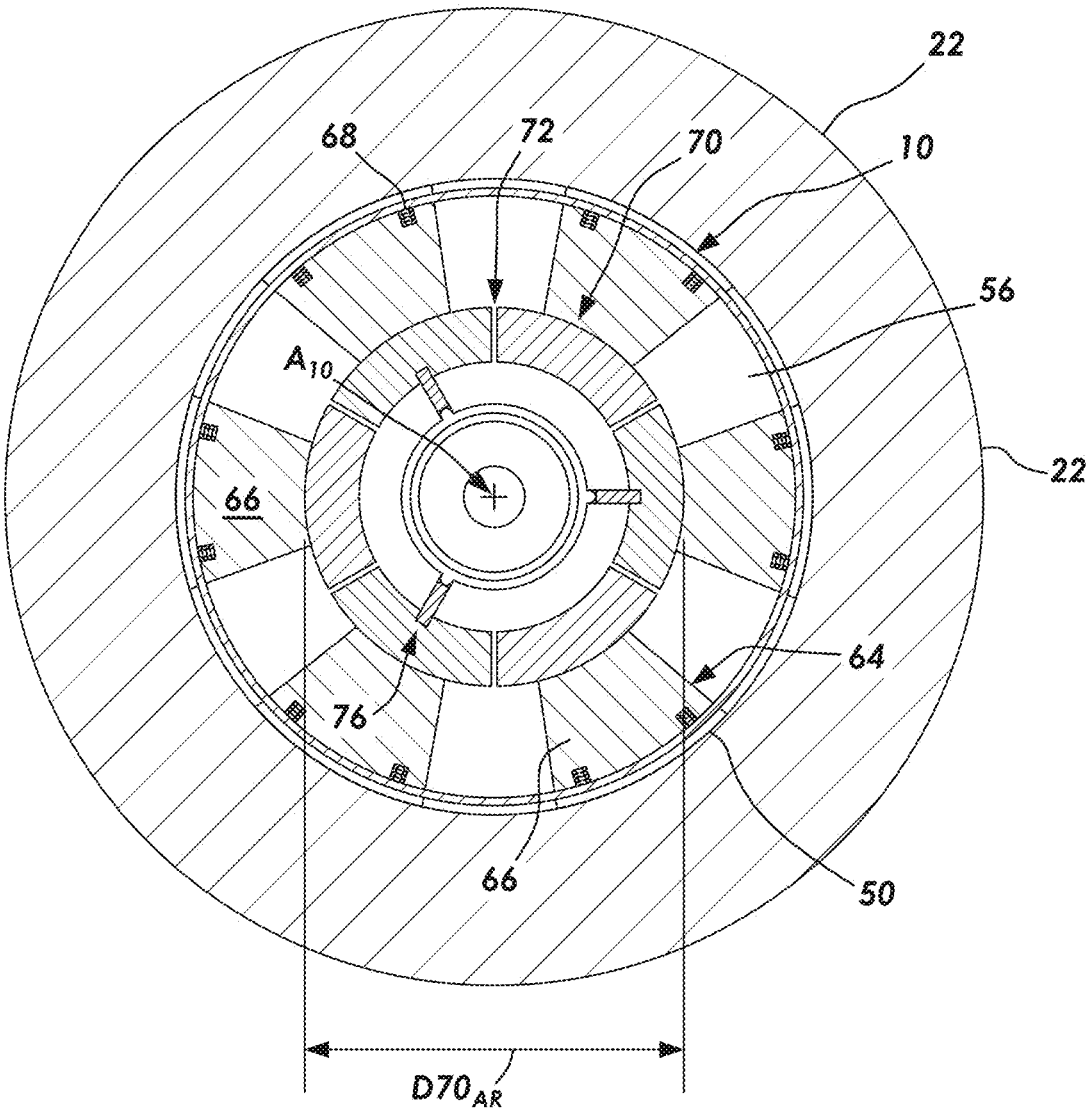
FIG. 5 is an overhead partial sectional view of the BPV and tubing hanger of FIG. 4 and taken along lines 5-5.

Referring to FIGS. 4 and 5, a sleeve assembly 69 is shown inserted within bore 38, which is disposed radially within recesses 64 and thread segment blocks 66. The sleeve assembly 69 includes a ring like retention sleeve 70 having an outer surface that is in abutting contact with inner radial surfaces of the thread segment block 66. In the configuration of FIGS. 4 and 5 the sleeve assembly 69 is in what is referred to as an armed configuration. In the armed configuration the outer threads 50 project readily outward from body 54. In this configuration the retention sleeve 70 is shown made up of a number of arc-like segments that circumscribe axis $A_{10}$ of the BPV 10. Gaps 72 are shown between adjacent segments of the retention sleeve 70 when in the armed configuration. Also shown in FIG. 5, is the diameter $D70_{AC}$ of the retention sleeve 70 when the sleeve assembly 69 is in the armed configuration. Circumscribed by the retention sleeve 70 is an actuation sleeve 74, which as described in more detail below is axially movable with respect to the retention sleeve 70. Shear pins 76 are shown that provide a frangible connection between the sleeves 70, 74. Optionally, a seal 78 is set between the sleeves 70, 74 to provide a barrier to fluid flow between these sleeves 70, 74. In the example shown, seal 78 is depicted as a chevron type seal. Further shown in FIG. 4 is that the bore 38 has a diameter $D_{38}$ that varies at different portions of body 54, such as in the upper section 56 where diameter $D_{38}$ is greater than in the other sections 58, 60, 62. Further shown in FIG. 4, is that the threads 48 are formed along an inner surface of the actuation sleeve 74. A channel 80 is shown formed into an outer surface of the actuation sleeve 74 at its lower end, which defines a smaller diameter portion of the actuation sleeve 74. For the purposes of discussion herein, the portion of the actuation sleeve 74 above the channel 80 is referred to as the larger diameter portion.

Figure 6:
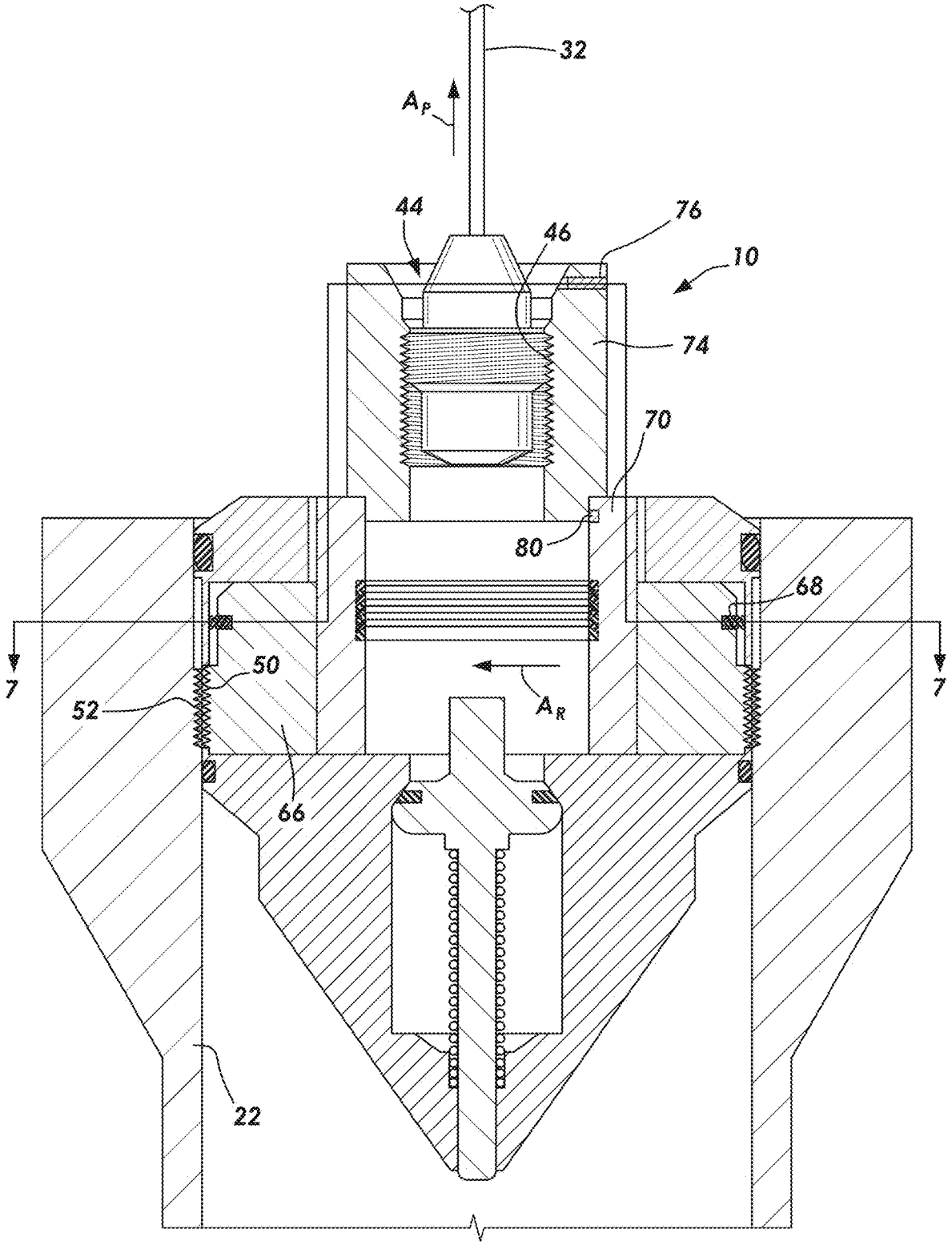
FIG. 6 is a side partial sectional view of activating release features of the BPV of FIG. 4.
Figure 7:
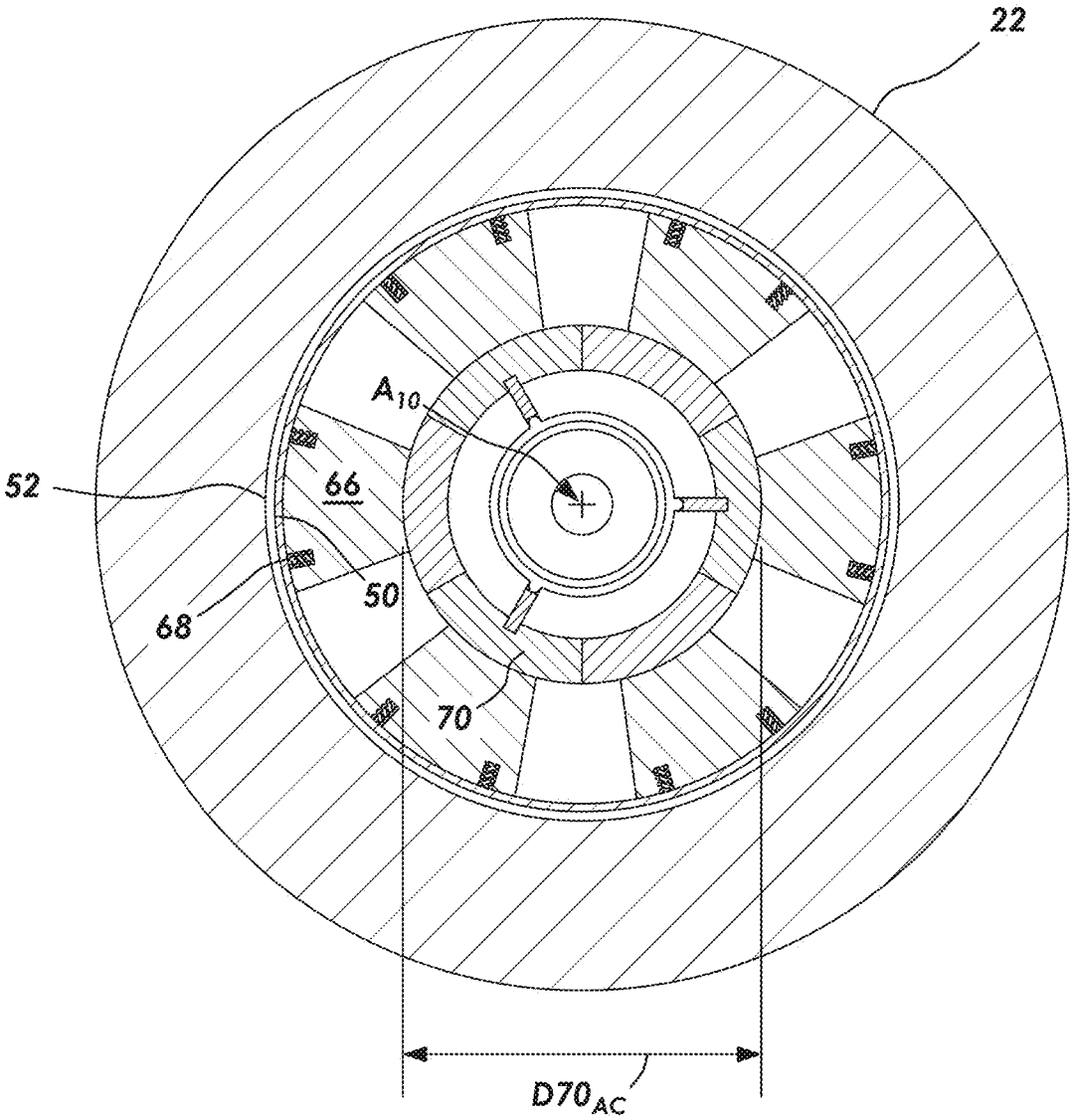
FIG. 7 is an overhead partial sectional view of the BPV and tubing hanger of FIG. 5 and taken along lines 7-7.
Figure 8:
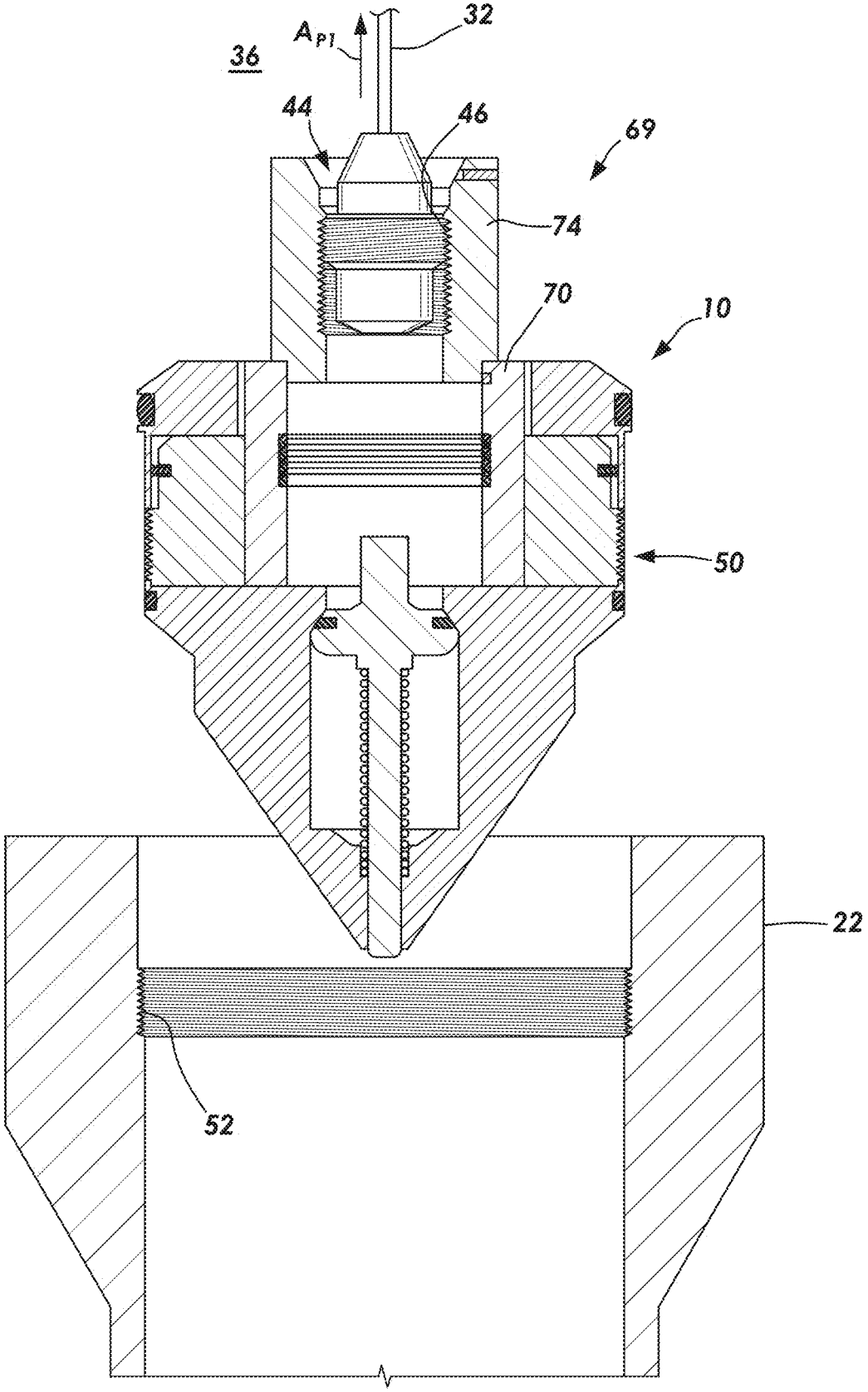
FIG. 8 is a side partial sectional view of removing the BPV of FIG. 6 from the tubing hanger.

Referring now to FIG. 6, shown is an example of operation in which the BPV 10 is not removable from within the tubing hanger 22 by conventional means, i.e. using the rod 32 and connector 44 to disengage outer threads 50 from inner threads 52. In this example, the contingency release means of the BPV 10 are actuated by exerting an upward force onto actuation sleeve 74 by an amount that overcomes the yield strength of the shear pins 76 to decouple sleeves 70, 74 from one another, and that moves the actuation sleeve 74 axially from within the retention sleeve 70 a distance so that the larger diameter portion of the actuation sleeve 74 is moved from within the retention sleeve 70, and only the portion of the actuation sleeve 74 having the channel 80 (i.e., the smaller diameter portion) remains within the retention sleeve 70. The smaller diameter portion of the retention sleeve 74, due to the channel 80, allows for inward radial movement of the retention sleeve 70 as illustrated by arrow AR. Referring back to FIG. 5, the gaps 72 between the segments of the retention sleeve 70 allow for collapsing of the retention sleeve 70 due to the movement of actuation sleeve 74 from within the retention sleeve 70. The collapsing, or the radial reduction, of the retention sleeve 70 when the sleeve assembly 69 is in the activated configuration is illustrated in axial view in FIG. 7, in which the retention sleeve 70 has a diameter $D70_{AC}$, which is less than diameter $D70_{AR}$ (FIG. 5) of the retention sleeve 70 when the sleeve assembly 69 is in the armed configuration. With the outer surface of retention sleeve 70 moved radially inward, the biasing force of the springs 68 urges the thread block segments 66 radially inward. Radial inward movement of the thread block segments 66 in turn, moves the outer threads 50 radially inward. Moving threads 50 radially inward disengages threads 50 from 52 to decouple BPV 10 from tubing hanger 22. When the BPV 10 becomes decoupled from the tubing hanger 22, a further upward force as shown by arrow $A_{P1}$ in FIG. 8 is used for withdrawing the BPV 10 from within the tubing hanger 22 and the wellhead assembly 12 (FIG. 1). Latch means (not shown) couples the retention sleeve 70 with actuation sleeve 74 when the sleeve assembly 69 is shown in the actuation configuration of FIGS. 6 through 8. The latch mechanism provides adequate mechanical support so that upward pull with force Api upwardly moves the BPV 10 out from wellhead assembly 12. An advantage of the device described herein is that in situations when inner threads 52 become fouled or otherwise create a situation where conventional means of removing a BPV from within a wellhead assembly require unscrewing the BPV, a contingency release is activated so that the threaded engagement is disengaged to allow for free removal of the BPV 10.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. In embodiments, any conventional lubricator is used for installing the BPV 10, removing the BPV 10, and/or activating the contingency means. These and other similar modifications will readily suggest themselves to those skilled in the art, and are intended to be encompassed within the spirit of the present invention disclosed herein and the scope of the appended claims.

What is claimed is:

1. A back pressure valve for use in a wellhead assembly comprising:

a body having an axis;

a recess in the body;

a thread segment block radially moveable within the recess;

a sleeve assembly selectively changeable from an armed configuration in which the sleeve assembly forms a barrier to radial inward movement of the thread segment block, to an activated configuration in which the sleeve assembly allows radial inward movement of the block; and threads on an outer surface of the thread segment block that are in selective threaded engagement with threads on an inner surface of a bore within the wellhead assembly when the sleeve assembly is in the armed configuration, the threads being spaced radially inward and disengaged from the threads on the inner surface of the bore when the sleeve is in the activated configuration;

a spring in biasing contact with the outer surface of the block.

2. The back pressure valve of claim 1, wherein a portion of the body forms a skirt that circumscribes a portion of the recess, and wherein the spring is compressed between the thread segment block and the skirt when the sleeve assembly is in the armed configuration and exerts a biasing force that moves the thread segment block radially inward when the sleeve assembly is in the activated configuration.

3. The back pressure valve of claim 1, wherein the sleeve assembly comprises a retention sleeve adjacent a radial inward side of the thread segment block and an actuation sleeve axially moveable within the retention sleeve.

4. The back pressure valve of claim 3, wherein a diameter of a lower end of the actuation sleeve is reduced to define a larger diameter portion and a lower diameter portion, and wherein the retention sleeve is radially compressible, wherein when the actuation sleeve is moved a distance axially upward so that the larger diameter portion is above an upper end of the retention sleeve, the retention sleeve compresses radially inward into contact with the lower diameter portion to allow inward radial movement of the thread segment block to disengage threads on the thread segment block from threads on the inner surface of the bore.

5. The back pressure valve of claim 4, wherein the retention sleeve comprises arc like segments with gaps between adjacent segments when the sleeve assembly is in the armed configuration.

6. The back pressure valve of claim 4, wherein the retention sleeve comprises a material that buckles when the sleeve assembly changes from the armed configuration into the activated configuration.

7. The back pressure valve of claim 3, further comprising threads on an inner surface of the actuation sleeve that are selectively engaged by a connector for installing the back pressure valve in the wellhead assembly, for removing the back pressure valve from the wellhead assembly, and for changing the sleeve assembly from the armed configuration into the activated configuration.

8. The back pressure valve of claim 1, further comprising a plurality of recesses and a plurality of thread segment blocks, wherein the plurality of thread segment blocks are radially moveable in the plurality of recesses and wherein each of the plurality of thread segment blocks comprise threads to form a threaded surface that extends radially outward from the body when the sleeve assembly is in the armed configuration and that is retracted when the sleeve assembly is in the activated configuration.

9. A back pressure valve for use in a wellhead assembly comprising:

a body having an axial bore;

a sleeve assembly in the bore having an outer diameter that is selectively reduced by reconfiguring the sleeve assembly from an armed configuration to an actuated configuration; and thread block segments that are radially moveable within recesses in the body, the thread block segments having outer radial surfaces with outer surface threads that selectively engage inner surface threads in the wellhead assembly when the sleeve assembly is in the armed configuration and that are disengaged from the inner surface threads when the sleeve assembly is in the activated configuration, the sleeve assembly comprising a retention sleeve that radially compresses when the sleeve assembly is reconfigured into the actuation configuration, the retention sleeve having an outer surface adjacent inner radial surfaces of the thread block segments.

10. The back pressure valve of claim 9, wherein the inner surface threads are formed along an inner surface of a tubing hanger inside the wellhead assembly.

11. The back pressure valve of claim 9, wherein lower portions of the recesses extend radially from the axial bore in the body to an outer surface of the body and wherein upper portions of the recesses have radial terminal ends that are spaced radially inward from an outer surface of the body to define skirts that are axially adjacent the outer surface threads.

12. The back pressure valve of claim 11, further comprising springs between the skirts and the thread segment blocks that bias the thread segment blocks radially inward.

13. The back pressure valve of claim 9, wherein the sleeve assembly further comprises an actuation sleeve circumscribed by the retention sleeve, and wherein telescoping the actuation sleeve from within the retention sleeve changes the sleeve assembly from the armed configuration into the actuated configuration.

14. A method of handling a back pressure valve in a wellhead assembly comprising:

obtaining a back pressure valve that comprises a body with a bore, a sleeve assembly in the bore comprising inner and outer sleeves that are concentric to one another, the sleeve assembly being changeable from an armed configuration into an activated configuration, recesses in the body that extend radially outward from the bore, thread block segments in the recesses having outer threads that project radially past an outer surface of the body when the sleeve assembly is in the armed configuration and that retract radially inward from the outer surface of the body when the sleeve assembly is in the activated configuration;

installing the back pressure valve in the wellhead assembly by engaging the outer threads with inner threads formed within the wellhead assembly;

changing the sleeve assembly from the armed configuration into the activated configuration to disengage the outer threads from the inner threads by axially moving an inner sleeve from within an outer sleeve so that a radius of the outer sleeve reduces and allows the thread block segments to move radially inward; and removing the back pressure valve from the wellhead assembly.

15. The method of claim 14, further comprising applying a radial inward force against the thread block segments.

16. The method of claim 15, wherein the radial inward force is from springs disposed between an outer skirt on the body of the back pressure valve and outer surfaces of the thread block segments.

17. The method of claim 14, wherein a diameter of the inner sleeve changes to define a larger diameter portion and a smaller diameter portion, and wherein changing the sleeve assembly into the activated configuration comprises positioning the inner sleeve so that the larger diameter portion outside of the outer sleeve and the smaller diameter portion remains within the outer sleeve.

18. The method of claim 14, wherein the inner and outer sleeves are coupled together when in the activated configuration, and wherein removing the back pressure valve from the wellhead assembly comprises engaging threads on an inner surface of the inner sleeve with a connector, and applying an upward force onto the connector.

* * * * *